US005724020A

United States Patent [19]

Hsu

[11] Patent Number: 5,724,020

[45] Date of Patent: Mar. 3, 1998

[54] VOICE WARNING SYSTEM FOR FIRE ACCIDENTS

[76] Inventor: Ching-Fu Hsu, P.O. Box 82-144, Taipei, Taiwan

[21] Appl. No.: 648,700

[22] Filed: May 16, 1996

[51] Int. Cl.[6] ..... G08B 25/08

[52] U.S. Cl. ..... 340/286.05; 340/331; 340/332; 340/692; 340/518

[58] Field of Search ..... 340/286.05, 584, 340/588, 589, 692, 331, 332, 517, 518; 379/37–40, 42–45

[56] References Cited

U.S. PATENT DOCUMENTS

| | | | |
|---|---|---|---|
| 4,258,332 | 3/1981 | West | 330/297 |
| 4,531,114 | 7/1985 | Topol et al. | 340/333 |
| 4,816,809 | 3/1989 | Kim | 340/692 |
| 4,894,642 | 1/1990 | Ashbaugh et al. | 340/539 |
| 5,349,338 | 9/1994 | Routman et al. | 340/692 |
| 5,460,228 | 10/1995 | Butler | 340/692 |

*Primary Examiner*—Donnie L. Crosland
*Attorney, Agent, or Firm*—A & J

[57] ABSTRACT

A voice warning system for fire accidents including a plurality of fire sensors, a first multiplex selector, a detecting and scanning circuit, a locking circuit, a decoding circuit, a memory circuit, a second multiplex selector, a scanning circuit, a load, a time pulse controlling circuit, a fire emergency assistance calling circuit, and a plurality of loudspeakers 12, the sensors and the loudspeakers being designed to arrange in appropriate positions and the other circuits being disposed with a fire-proof control box, whereby in case of a fire accident, the system will give fleeing instructions to all people in a building through the loudspeakers and will automatically call the fire emergency assistance at the same time.

1 Claim, 2 Drawing Sheets

VOICE WARNING SYSTEM FOR FIRE ACCIDENTS

BACKGROUND OF THE INVENTION

1. Field of the Invention

This invention relates to a voice warning system for fire accidents.

2. Description of the Prior Art

It is often known that many people die of suffocation and flames in a building, especially a large and high building. In order to survive the toxic environment associated with fires, victims need to reach breathable air in a minute. Hence, there are known fire alarms used for giving warning signals to the people in a building. However, such alarms are simply apparatuses for giving a warning of danger and cannot tell people where to flee from the fire thereby making it impractical in use.

Therefore, it is an object of the present invention to provide a voice warning system for fire accidents which can obviate and mitigate the above-mentioned drawbacks.

SUMMARY OF THE INVENTION

This invention is directed to a voice warning system for fire accidents.

It is the primary object of the present invention to provide a voice warning system for fire accidents which will can tell people where to flee from the fire through loudspeakers in case of fire accidents.

It is another object of the present invention to provide a voice warning system for fire accidents which will automatically call the fire emergency assistance.

It is still another object of the present invention to provide a voice warning system for fire accidents which may ensure the safety of all people in a building.

It is still another object of the present invention to provide a voice warning system for fire accidents which is simple in construction.

It is a further object of the present invention to provide a voice warning system for fire accidents which is practical in use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
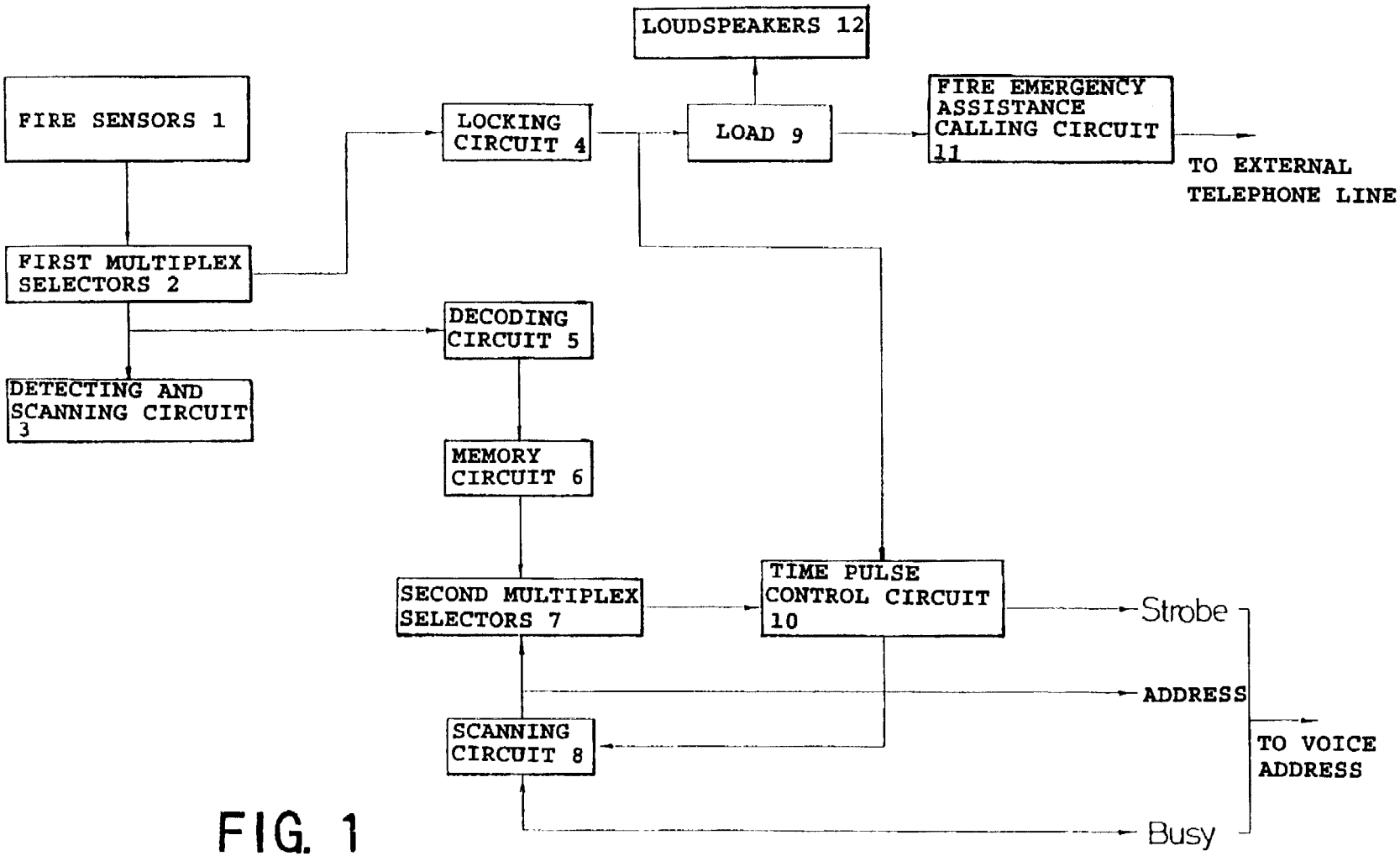
FIG. 1 is a block diagram of the present invention.
Figure 2:
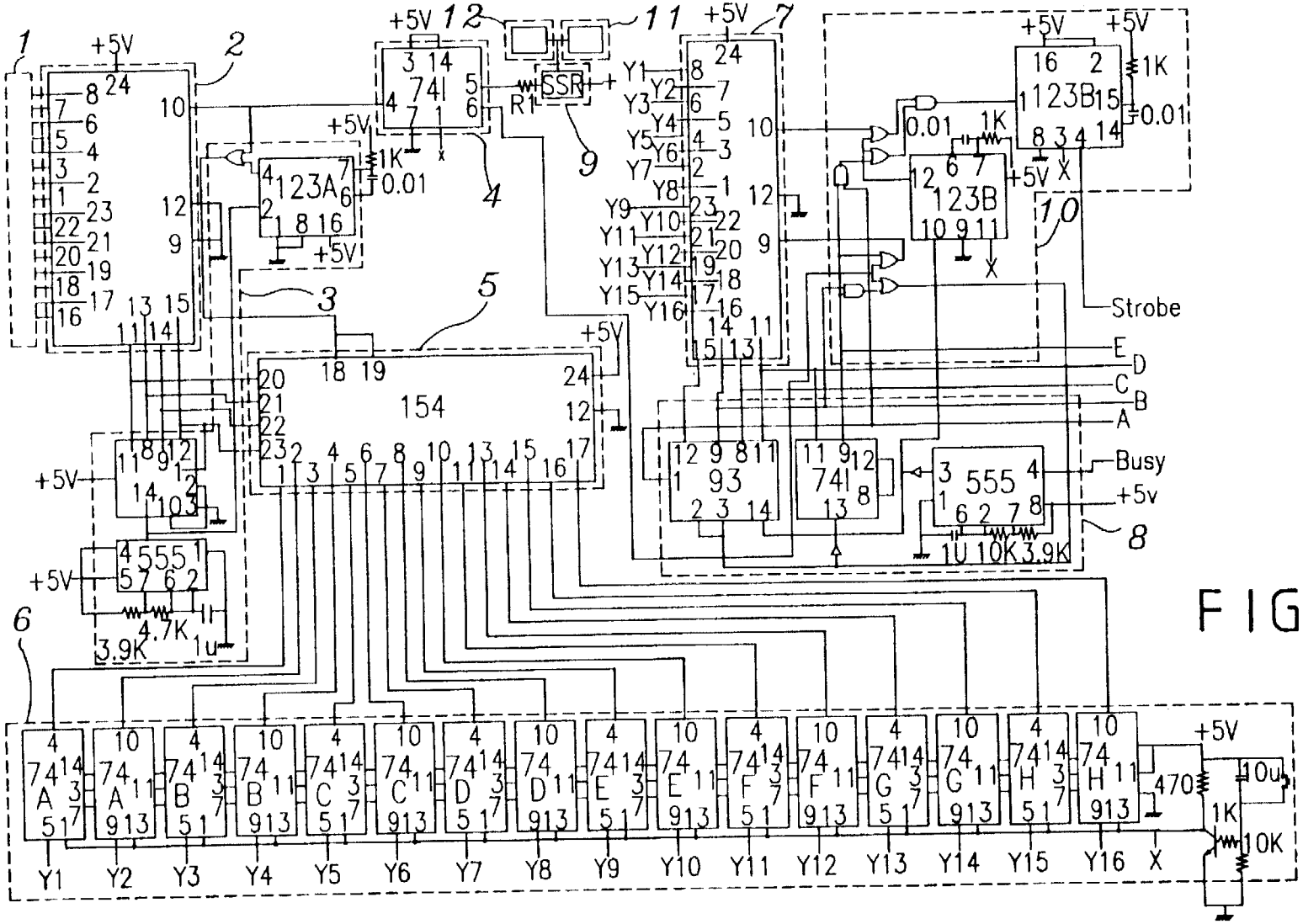
FIG. 2 is a circuit diagram of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, the voice warning system for fire accidents according to the present invention comprises a plurality of fire sensors 1, a first multiplex selector 2, a detecting and scanning circuit 3, a locking circuit 4, a decoding circuit 5, a memory circuit 6, a second multiplex selector 7, a scanning circuit 8, a load 9, a time pulse control circuit 10, a fire emergency assistance calling circuit 11 and a plurality of loudspeakers 12. The fire sensors 1 and the loudspeakers 12 are arranged in appropriate positions of a building and the other circuits are mounted within a control box provided with fire proof material such as plaster.

The functions of the component parts of the present invention will be described hereinafter as follows:

Any one of the fire sensors i will output a signal to the first multiplex selector 2 when sensing a fire.

As the first multiplex selector 2 receives a signal from the sensor(s), it will send a low potential signal to the locking circuit 4 and the decoding circuit 5 according to the fire spot detected by the detecting and scanning circuit 3.

The detecting and scanning circuit 3 is used for scanning and detecting whether there is fire in other spots.

The locking circuit 4 is used for locking memory of a fire accident and connected to an external load SSR (including the loudspeakers 12) of the load 9 and the time pulse control circuit 10 for producing time series pulses.

The decoder 5 is used for receiving low potential signals from the first multiplex selector 2 and decoding the fire spot through SN74123 and SN64154.

The memory circuit 6 utilizes sixteen groups of SN7474 (from A to H) to memorize the fire spots and output signals (from Y1 to Y16) until the fire is extinguished and the reset button is pressed to clear the memory.

The second multiplex selector 7 cyclicly scans the output signal from Y1 to Y16 from the memory circuit 6. As the second multiplex selector 7 receives output signal from the memory circuit 6, it will synchronously output low potential to the time sequence control circuit 10.

The scanning circuit 8 transmits the cyclic scanning position signal from the oscillator 555 and SN7493 to the second multiplex selector 7 and sends out voice address output reference to a voice card. When the voice card is working, it will output a busy signal to stop the cyclic scanning.

The load 9 (SSR) is externally connected to the loudspeakers 12 and will keep working in case of fire until reset.

The time pulse control circuit 10 includes a positive OR gate, positive AND gate, non-positive AND gate, SN47474 and SN74123 and is designed for controlling the cyclic scanning function of the scanning circuit 8.

The fire emergency assistance calling circuit 11 is an additional device which will automatically call the fire emergency assistance in the event of fire accidents.

The loudspeakers 12 which is connected to the load 9 is used for giving a warning of danger and telling people to flee from the fire.

The working principle of the present invention will now be described as follows:

When any one of the fire sensors 1 senses a fire, a signal will be sent to the first multiplex selector 2 which will detect the fire spot through the detecting and scanning circuit 3 and will synchronously send out a low potential signal to the locking circuit 4 and the decoding circuit 5. The locking circuit 4 is used for locking fire memory and connected to the load 9 and the time pulse control circuit 10 for producing time series pulses. The decoding circuit 5 is designed for decoding the fire spot. The memory circuit 6 memorizes the fire spot and outputs 16 signals to the second multiplex selector 7 which will cyclicly scan position signal via the scanning circuit 8 and will syrnchronously send out low potential to the time pulse control circuit 10 and voice address output reference to a voice card when receiving signal. The voice card sends out a busy signal to block cyclic scanning if the voice card is working. The time pulse control circuit 10 includes positive OR gate, positive AND gate, non-positive AND gate, SN7474 and SN74123IC and is used for controlling cyclic scanning function of the scanning circuit 8 and sending out a strobe signal to control the voice card.

Hence, in case of a fire accident, the voice warning system according to the present invention will tell the people where to flee from the fire spot through the loudspeakers 12 thereby ensuring their safety.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A voice warning system for fire accidents comprising a plurality of fire sensors, a first multiplex selector, a detecting and scanning circuit, a locking circuit, a decoding circuit, a memory circuit, a second multiplex selector, a scanning circuit, a load, a time pulse controlling circuit, a fire emergency assistance calling circuit, and a plurality of loudspeakers 12, said sensors and said loudspeakers being designed to arrange in appropriate positions and the other circuits being disposed with a fire-proof control box, whereby when any one of said fire sensors senses fire, a signal will be sent to said multiplex selector which will detect fire position through said detecting and scanning circuit and will synchronously send out low potential signal to said locking circuit and said decoding circuit, said locking circuit being used for locking fire memory and connected to said load and said pulse control circuit for producing time sequence pulse, said decoding circuit being designed for decoding the fire position, said memory circuit memorizing said fire position and outputting 16 signals to said second multiplex selector which will cyclic scan position signal via said scanning circuit and will synchronously send out low potential to said time pulse control circuit and voice address output reference to a voice card when receiving signal, said voice card sending out a busy signal to block cyclic scanning if said voice card is working, said time pulse control circuit including positive OR gate, positive AND gate, non-positive AND gate, SN7474 and SN74123IC and being used for controlling cyclic scanning function of said scanning circuit and sending out a strobe signal to control said voice card.

* * * * *